US009016457B2

(12) United States Patent
Suetaka

(10) Patent No.: US 9,016,457 B2
(45) Date of Patent: Apr. 28, 2015

(54) MEDIUM STORAGE AND FEEDING DEVICE AND MEDIUM PROCESSING DEVICE

(71) Applicant: Oki Electric Industry Co., Ltd., Tokyo (JP)

(72) Inventor: Michio Suetaka, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/002,360

(22) PCT Filed: Dec. 3, 2012

(86) PCT No.: PCT/JP2012/081295

§ 371 (c)(1),
(2) Date: Aug. 29, 2013

(87) PCT Pub. No.: WO2013/145449

PCT Pub. Date: Oct. 3, 2013

(65) Prior Publication Data

US 2014/0090949 A1 Apr. 3, 2014

(30) Foreign Application Priority Data

Mar. 26, 2012 (JP) ..... 2012-069688

(51) Int. Cl.
*G07F 7/04* (2006.01)
*B65H 23/06* (2006.01)
(Continued)

(52) U.S. Cl.
CPC ..... *B65H 5/28* (2013.01); *B65H 29/006* (2013.01); *B65H 2301/41912* (2013.01); *B65H 2403/732* (2013.01); *B65H 2701/1912* (2013.01); *G07D 11/0006* (2013.01)

(58) Field of Classification Search
CPC ... G07D 13/00; G07D 2211/00; B65H 23/06; B65H 23/063; B65H 39/14
USPC ..... 194/206, 350; 242/334, 410, 415, 242/415.1, 420.4, 528, 611
See application file for complete search history.

(56) References Cited

U.S. PATENT DOCUMENTS 5,064,074 A * 11/1991 Edin et al. ..... 209/534
6,371,473 B1 * 4/2002 Saltsov et al. ..... 271/3.01
(Continued)

FOREIGN PATENT DOCUMENTS

CN 1578971 A 2/2005
CN 101423151 A 5/2009
(Continued)

OTHER PUBLICATIONS

Chinese Office Action issued on Dec. 3, 2014, with English translation, (14 pages).

*Primary Examiner* — Mark Beauchaine
(74) *Attorney, Agent, or Firm* — Rabin & Berdo, P.C.

(57) ABSTRACT

A medium storage and feeding device and a medium processing device that may prevent occurrences of faults more reliably than the related art. A drum (21) is provided that winds up a banknote BL nipped by pairs of tapes (28L, 28R, 30L and 30R) together with the pairs of tapes. Torque limiters (25L, 25R, 27L and 27R) are separately provided at each of tape reels (24L, 24R, 26L and 26R). The torque limiters control torques between the tape reels and reel rotation axle shafts (22 and 23), such that tensions applied to the tapes between the tape reels (24L, 24R, 26L and 26R) and the drum (21) are constant. Thus, tensions on the tapes between the respective tape reels and the drum may be kept constant, banknote nipping stability may be improved, and occurrences of faults may be prevented more reliably than in the related art.

5 Claims, 10 Drawing Sheets

(51) Int. Cl.

| | |
|---|---|
| ***B65H 5/28*** | (2006.01) |
| ***B65H 29/00*** | (2006.01) |
| ***G07D 11/00*** | (2006.01) |

(56) References Cited

U.S. PATENT DOCUMENTS

| | | | | |
|---|---|---|---|---|
| 2003/0116400 | A1 * | 6/2003 | Saltsov et al. | 194/207 |
| 2009/0108115 | A1 | 4/2009 | Iwatsuki | |
| 2011/0073611 | A1 | 3/2011 | Tosaka et al. | |

FOREIGN PATENT DOCUMENTS

| | | | |
|---|---|---|---|
| JP | 2005-505068 | A | 2/2005 |
| JP | 2009-107824 | A | 5/2009 |
| JP | 2010-006494 | A | 1/2010 |

* cited by examiner

MEDIUM STORAGE AND FEEDING DEVICE AND MEDIUM PROCESSING DEVICE

TECHNICAL FIELD

The present invention relates to a medium storage and feeding device and to a medium processing device, and is excellent for application to, for example, a temporary holding section of an automatic teller machine installed in a financial institution or the like.

BACKGROUND ART

An automatic teller machine (referred to hereinafter as an ATM) is structured with a cash deposit and withdrawal section that is formed with a deposit aperture and a withdrawal aperture for banknotes, a verification section that verifies denominations, authenticity and the like of banknotes, a temporary holding section that temporarily stores banknotes, plural banknote storage vaults that retain the respective denominations, and conveyance paths and the like that connect between these sections.

The temporary holding section thereof stores and feeds banknotes by, for example, winding and unwinding tapes between reels and a drum. This kind of temporary holding section is referred to herein as a drum winding system.

A temporary holding section of this drum winding system is known in which, as an example, banknotes are nipped between a pair of upper and lower tapes and, in this state, the banknotes are stored and fed out by winding and unwinding of the tapes.

This temporary holding section is illustrated in FIG. 14. FIG. 14 is a side view in which the right side of the drawing represents a front side and the left side of the drawing represents a rear side.

As is shown in FIG. 14, a temporary holding section 200 is principally structured by a drum 201, a pair of upper and lower tape reels 202 and 203, a pair of upper and lower tapes 204 and 205, and plural rollers 206 to 210.

In the temporary holding section 200, the upper tape 204 is drawn out forward from the upper tape reel 202, which is disposed at the upper rearward side of the circular barrel-shaped drum 201. This upper tape 204 is wound round an upper tape roller 206, which is disposed at the upper forward side of the drum 201, is turned back to the rearward from the upper tape roller 206 and is guided to an upper end portion of the drum 201.

Meanwhile, the lower tape 205 is drawn out forward from the lower tape reel 203, which is disposed at the lower rearward side of the drum 201. This lower tape 205 is wound round a first lower tape roller 207, which is disposed at the lower forward side of the drum 201. Hence, the lower tape 205 is guided upward from the first lower tape roller 207 and wound round a second lower tape roller 208, which is disposed below the upper tape roller 206 a predetermined spacing apart therefrom. Hence, the lower tape 205 is turned back to the rearward from the second lower tape roller 208 and is guided to the upper end portion of the drum 201.

Further, the upper tape 204 and the lower tape 205 are pressed against the upper end portion of the drum 201, such that the upper tape 204 is superposed on top of the lower tape 205, by a pressing roller 209 that is disposed directly above the upper end portion of the drum 201. Respective distal end portions of the upper tape 204 and the lower tape 205 are fixed to a periphery side surface of the drum 201.

Then, the temporary holding section 200 winds the upper tape 204 and lower tape 205 onto the drum 201 from the upper tape reel 202 and lower tape reel 203 by rotating the drum 201 in a winding direction, which is the counterclockwise direction in the drawing, and unwinds the upper tape 204 and lower tape 205 from the drum 201 onto the upper tape reel 202 and lower tape reel 203 by rotating the drum 201 in an unwinding direction, which is the clockwise direction in the drawing.

When banknotes are to be stored in the temporary holding section 200 with this structure, a banknote BL is conveyed through plural conveyance rollers 210 disposed at the front side, and is fed in between the upper tape roller 206 and the second lower tape roller 208. At this time, the drum 201 is rotated in the direction of winding the tapes (referred to as "the winding direction" herein), and the upper tape reel 202 and lower tape reel 203 are rotated in directions of unwinding the tapes therefrom (referred to as "the unwinding directions" herein). Thus, a middle portion of the banknote BL is nipped between the upper tape 204 and the lower tape 205, and the banknote BL is stored by being wound onto the drum 201 together with the upper tape 204 and lower tape 205.

On the other hand, when banknotes are to be fed out, the temporary holding section 200 rotates the drum 201 in the unwinding direction thereof and the upper tape reel 202 and lower tape reel 203 are rotated in the winding directions thereof. Thus, a banknote BL is unwound from the drum 201 together with the upper tape 204 and lower tape 205, and the banknote BL is fed out from between the upper tape roller 206 and the second lower tape roller 208.

During winding and during unwinding, the rotation directions of the drum 201 and the lower tape reel 203 are the same as one another but the rotation direction of the upper tape reel 202 is the opposite direction.

In this manner, the temporary holding section 200 implements storage and feeding of the banknotes BL.

Heretofore, as a temporary holding section of this type in which a pair of upper and lower tapes are wound and unwound in a state in which a banknote is nipped between the tapes, an apparatus has been proposed (for example, see Patent Document 1: Japanese Patent Application Laid-Open (JP-A) No. 2009-107824) that applies constant tensions to the pair of upper and lower tapes by providing torque limiters between the tape reels and reel axles.

Meanwhile, a temporary holding section has also been proposed heretofore that may nip a banknote more assuredly and improve nipping stability, by using a plural number of pairs (for example, two pairs) of upper and lower tapes and, rather than nipping a middle portion of the banknote, nipping, for example, two end portions of the banknote with the pairs of upper and lower tapes.

DISCLOSURE OF INVENTION

Technical Problem

Incidentally, in a drum winding system temporary holding section, for example, as shown in FIG. 15, a winding diameter L when a banknote is wound on the drum 201 may be inconsistent between the two axial direction end portions of the drum 201 because of characteristics of the banknotes (uneven thicknesses and the like).

In this case, if, for example, two pairs of upper and lower tapes 204 and 205 are used to nip the two end portions of the banknote, because the winding diameter L of the drum 201 differs at the two end portions, a winding amount and an unwinding amount of the tapes per rotation of the drum are different between the respective tape pairs. As a result, there are differences in tape speeds between the pairs of upper and lower tapes.

When this difference between the tape speeds occurs, the tape speed difference causes inconsistencies in the tape tensions between the pairs of upper and lower tapes.

Using, for example, a conventional technology and providing one torque limiter between tape reels and a reel axle may be considered. However, the conventional technology is essentially a technology in which one pair of upper and lower tapes are kept at a constant tension. Accordingly, when a plural number of pairs of upper and lower tapes are used in a temporary holding section, it may not be possible to keep the tape tensions constant at one or other of the plural pairs, as a result of which the tape tensions at the plural pairs may not be kept constant.

If the tape tensions of the respective pairs cannot be kept constant, nipping stability of the banknotes may deteriorate, and faults such as jams and the like are more likely to occur during storing and during feeding of the banknotes.

In consideration of the problem described above, the present invention proposes a medium storage and feeding device and a medium processing device that may prevent occurrences of faults more reliably than the related art.

Solution to Problem

To solve this problem, a medium storage and feeding device of the present invention is a medium storage and feeding device that stores and feeds out a medium by winding and unwinding a set of two tapes, which nip the medium, between tape reels and a drum, the medium storage and feeding device including: a plural number of sets of the tapes; a plural number of sets of the tape reels that respectively wind up the plural sets of tapes; two reel rotation axle shafts that are rotation axles of the tape reels and that are separately provided for one tape reel and another tape reel of the respective sets; a drum that winds the medium nipped by the plural sets of tapes together with the plural sets of tapes; and torque control units that are independently provided at each of the tape reels and that control torques between the tape reels and the reel axle shafts such that tensions on the tapes between the tape reels and the drum are constant.

A medium processing device of the present invention includes: a verification section that verifies a medium; a temporary holding section that temporarily stores a medium verified by the verification section; and a banknote storage vault that stores a medium fed out from the temporary holding section, wherein the temporary holding section is a drum winding system that stores and feeds out a medium by winding and unwinding a set of two tapes, which nip the medium, between tape reels and a drum, and the temporary holding section includes: a plural number of sets of the tapes; a plural number of sets of the tape reels that respectively wind up the plural sets of tapes; two reel rotation axle shafts that are rotation axles of the tape reels and that are separately provided for one tape reel and another tape reel of the respective sets; a drum that winds the medium nipped by the plural sets of tapes together with the plural sets of tapes; and torque control units that are independently provided at each of the tape reels and that control torques between the tape reels and the reel axle shafts such that tensions on the tapes between the tape reels and the drum are constant.

Thus, the torque limiters that operate so as to keep the tape tensions constant are independently provided at each of the tape reels. Therefore, even if there is a difference in tape speeds between the plural sets of tapes, the tape tensions between the respective tape reels and the drum may be kept constant.

Advantageous Effects of Invention

According to the present invention, tape tensions between respective tape reels and a drum may be kept constant. Therefore, a medium storage and feeding device and a medium processing device that may improve nipping stability of a medium and that may prevent occurrences of faults more reliably than the related art may be provided.

BEST MODE FOR CARRYING OUT THE INVENTION

Herebelow, embodiments for carrying out the invention are described in detail using the attached drawings.

-1. First Embodiment-

-1-1. Structure of an Automatic Teller Machine-

Figure 1:
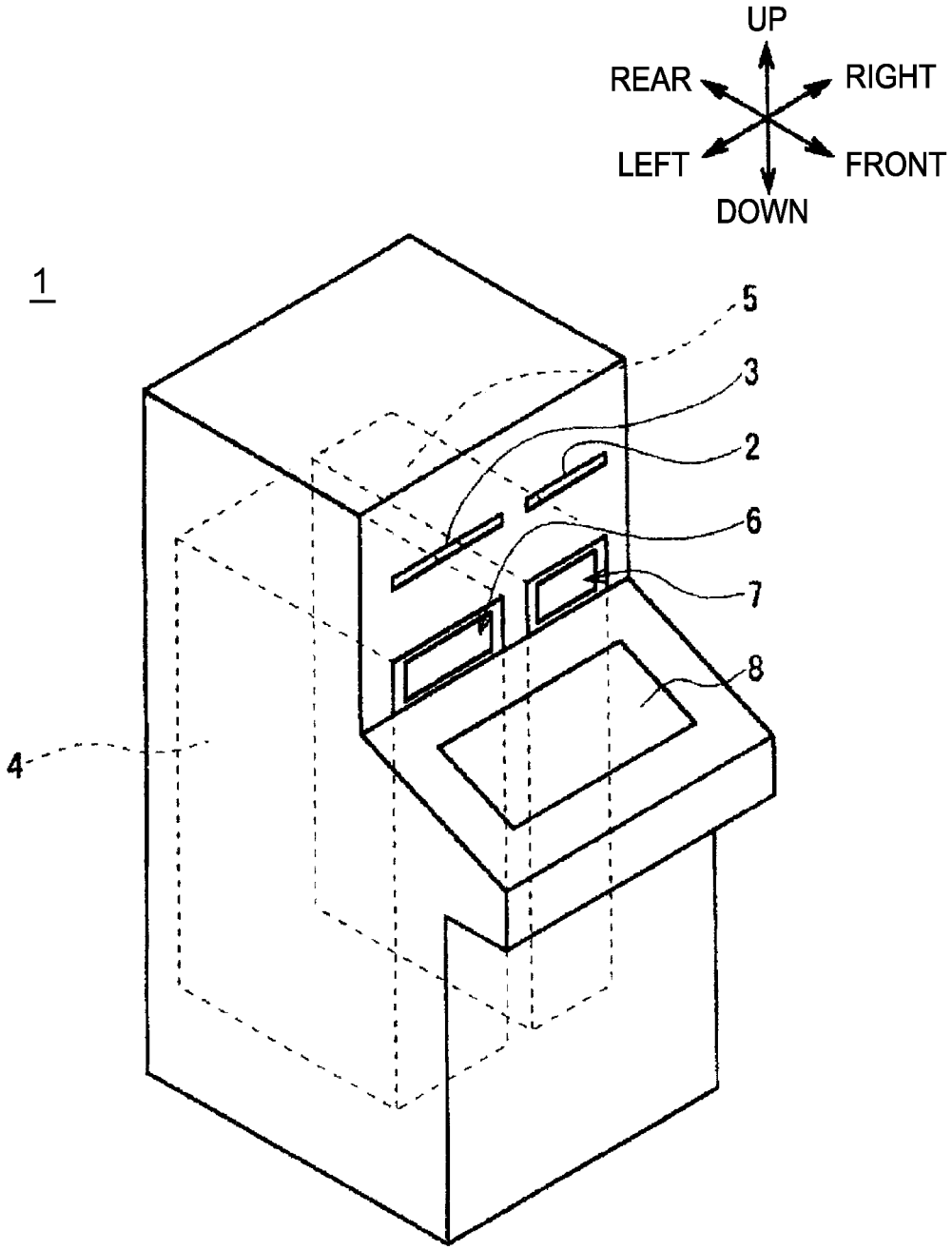
FIG. 1 is a schematic diagram showing the structure of an ATM.

First, a first embodiment is described. FIG. 1 shows an outline of the overall structure of an automatic teller machine (ATM) 1.

The ATM 1 uses cash cards, banknotes, bank books and the like as transaction media, and performs processes such as deposits and withdrawals of cash, bank transfers and the like in response to operations by users.

A card processing apparatus (not shown in the drawing) and a bank book processing apparatus (not shown in the drawing) are provided at an upper portion of the interior of the ATM 1. The card processing apparatus processes a user's cash card or the like. The bank book processing apparatus records the details of transactions and suchlike in a bank book.

The card processing apparatus processes a user's cash card, which is taken in through a card insertion aperture 2 provided in a front face of the ATM 1 (the face opposing the user). The bank book processing apparatus processes a bank book, which is taken in through a bank book insertion aperture 3 provided in the front face of the ATM 1.

A banknote deposit and withdrawal apparatus 4 that processes banknotes and a coin deposit and withdrawal apparatus 5 that processes coins are also provided inside the ATM 1.

A banknote insertion aperture 6 that opens in the front face of the ATM 1 is provided in the front face above the banknote deposit and withdrawal apparatus 4. Banknotes can be deposited and withdrawn via the banknote insertion aperture 6. Further, a coin insertion aperture 7 that opens in the front face of the ATM 1 is provided in the front face above the coin deposit and withdrawal apparatus 5. Coins can be deposited and withdrawn via the coin insertion aperture 7.

A display and operation unit 8 is provided at the middle of the front face of the ATM 1. The display and operation unit 8 is, for example, a liquid crystal display panel that serves as a display unit and a touch panel that serves as an operation unit. The display and operation unit 8 may display various screens and implement inputs of PIN numbers, transaction amounts and so forth.

-1-2. Structure of the Banknote Deposit and Withdrawal Apparatus-

Figure 2:
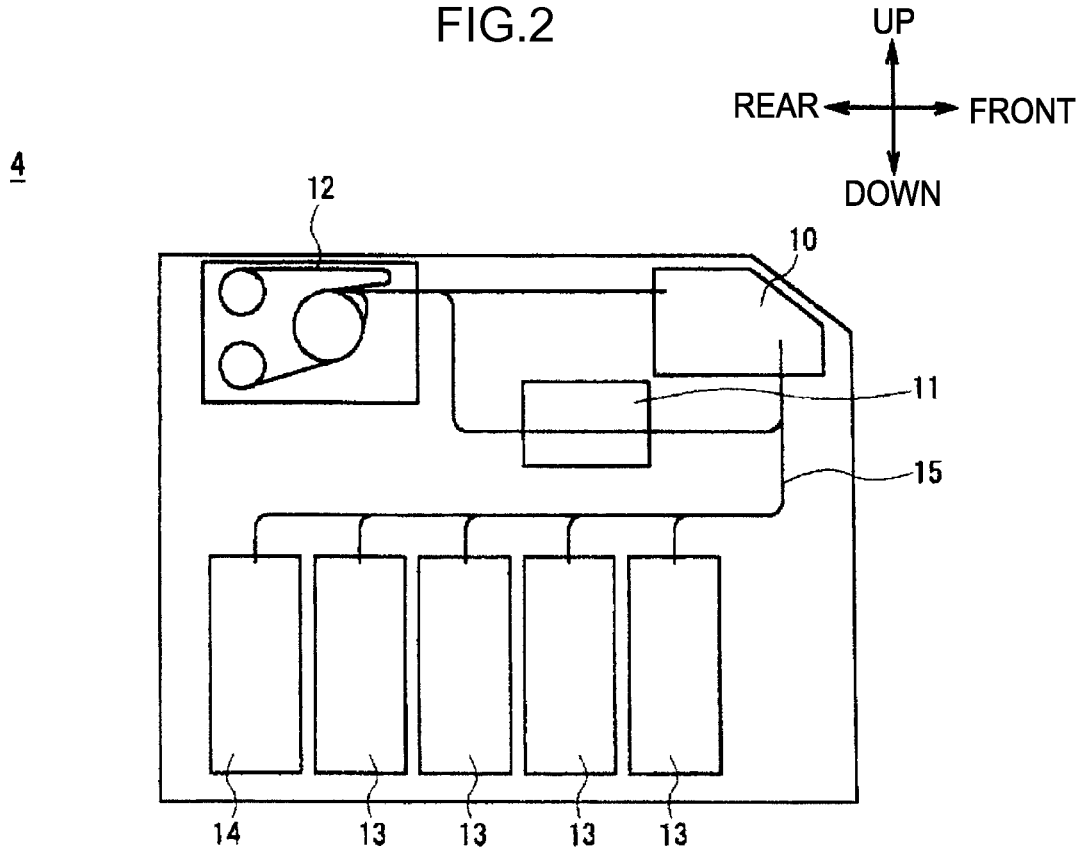
FIG. 2 is a line drawing showing the structure of a banknote deposit and withdrawal apparatus.

Now, internal structures of the banknote deposit and withdrawal apparatus 4 are described using FIG. 2. FIG. 2 is a side view, the right side of which shows the front side of the banknote deposit and withdrawal apparatus 4 and the left side of which shows the rear side.

The banknote deposit and withdrawal apparatus 4 is a banknote deposit and withdrawal apparatus of a "recycling" type, which uses deposited banknotes for withdrawals. A customer service section 10, a verification section 11 and a temporary holding section 12 are provided at an upper portion of the banknote deposit and withdrawal apparatus 4, and plural banknote storage vaults 13 and a reject vault 14 are provided at a lower portion of the banknote deposit and withdrawal apparatus 4.

Specifically, the customer service section 10 is disposed at the upper front face at an upper portion of the banknote deposit and withdrawal apparatus 4, and the above-mentioned banknote insertion aperture 6 is provided at the customer service section 10.

The verification section 11 is disposed at the upper portion of the banknote deposit and withdrawal apparatus 4, at a location below and behind the customer service section 10. The verification section 11 identifies whether banknotes are genuine or counterfeit, identifies whether the banknotes are intact or damaged, and identifies denominations, conveyance attitudes and the like of the banknotes. The temporary holding section 12, which temporarily retains the banknotes, is disposed at a location above and behind the verification section 11. This temporary holding section 12 is a drum winding system temporary holding section.

In the lower portion of the banknote deposit and withdrawal apparatus 4, the plural banknote storage vaults 13, which are long in the vertical direction, are arranged in a row in the front-rear direction, and the reject vault 14 is disposed behind the rearmost banknote storage vault 13.

A conveyance path 15 that links the customer service section 10, the verification section 11, the temporary holding section 12, the plural banknote storage vaults 13 and the reject vault 14 is provided in the banknote deposit and withdrawal apparatus 4. Banknotes are conveyed along the conveyance path 15 to the respective portions.

When a user inserts banknotes through the banknote insertion aperture 6 of the customer service section 10 during a deposit transaction, the banknote deposit and withdrawal apparatus 4 with this structure conveys each banknote to the verification section 11. If the banknote is identified as a proper banknote by the verification section 11, the banknote deposit and withdrawal apparatus 4 conveys the banknote to the temporary holding section 12 and stores the banknote. On the other hand, if the banknote is determined to be a deposit rejection banknote that is not suitable for deposit, the banknote deposit and withdrawal apparatus 4 returns the banknote to the customer service section 10 and returns the banknote through the banknote insertion aperture 6 to the user.

Thereafter, when a deposit amount is specified by the user, the banknote deposit and withdrawal apparatus 4 conveys banknotes stored in the temporary holding section 12 to the verification section 11 and identifies the denominations thereof, after which the banknotes are conveyed to the banknote storage vaults 13 in accordance with their denominations and retained.

When a user specifies a withdrawal amount during a withdrawal transaction, the banknote deposit and withdrawal apparatus 4 feeds banknotes from the banknote storage vaults 13 in accordance with the specified withdrawal amount and conveys each banknote to the verification section 11. If the banknote is determined to be a proper banknote by the verification section 11, the banknote deposit and withdrawal apparatus 4 conveys the banknote to the customer service section 10. On the other hand, if the banknote is determined to be a withdrawal rejection banknote that is not suitable for withdrawal, the banknote deposit and withdrawal apparatus 4 conveys the banknote to the temporary holding section 12 and stores the banknote.

Thereafter, the banknote deposit and withdrawal apparatus 4 conveys withdrawal rejection banknotes stored in the temporary holding section 12 to the reject vault 14 and retains these banknotes therein.

-1-3. Structure of the Temporary Holding Section-

Figure 3:
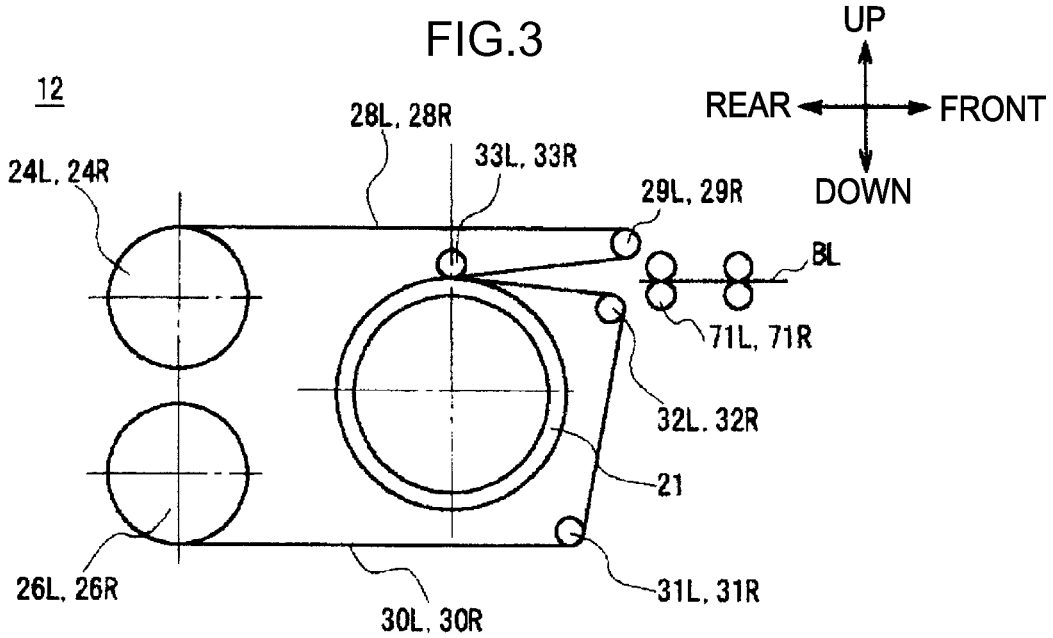
FIG. 3 is a line drawing showing structures (1) of a temporary holding section of a first embodiment.
Figure 4:
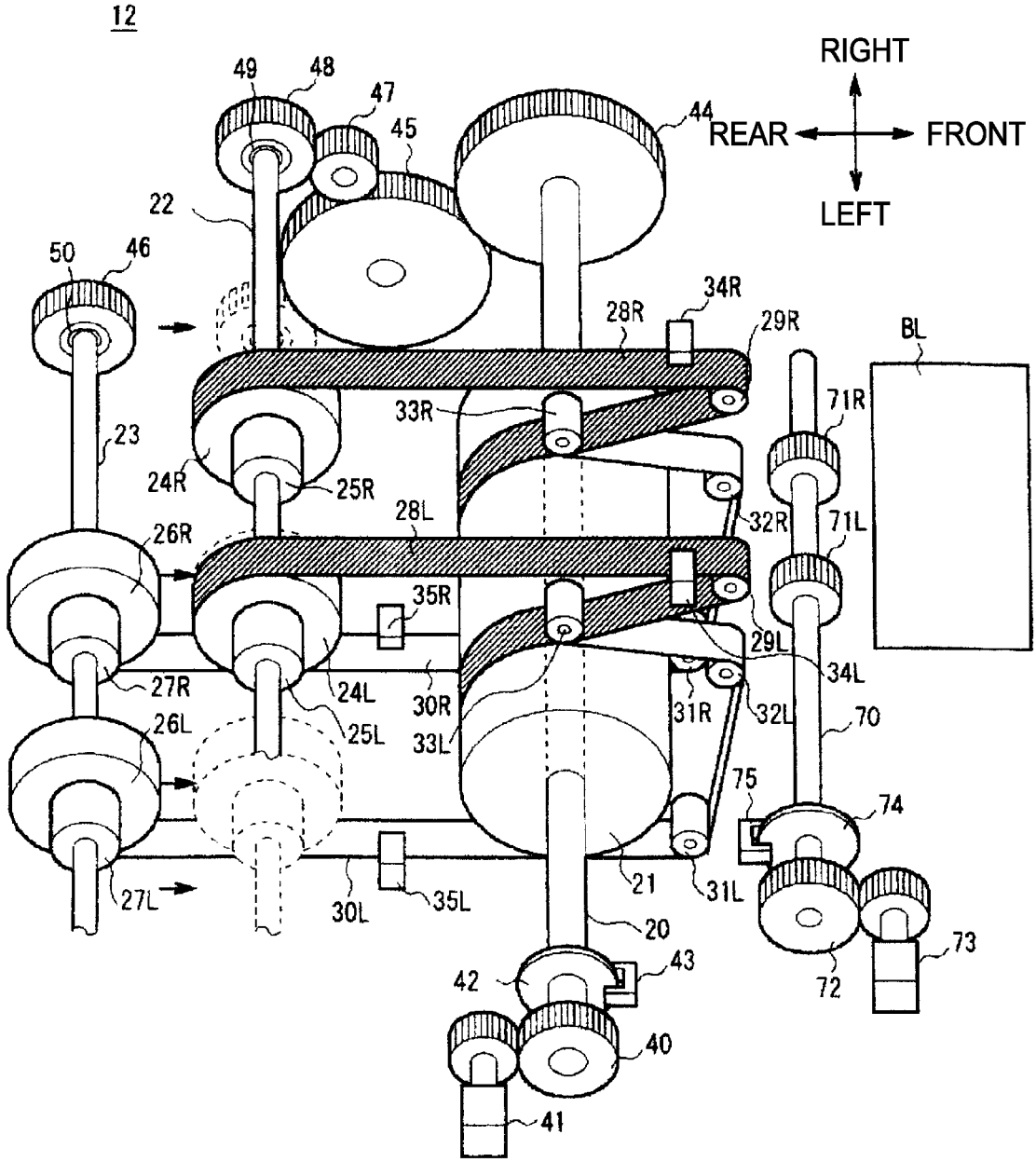
FIG. 4 is a line drawing showing structures (2) of the temporary holding section of the first embodiment.

Now, the structure of the temporary holding section 12 is described using FIG. 3 and FIG. 4. The temporary holding section 12 is a temporary holding section of a type that uses two pairs of upper and lower tapes and retains each of two end portions of a banknote with the respective pairs of tapes.

FIG. 3 is a side view, the right side of which shows the front side of the temporary holding section 12 and the left side of which shows the rear side. FIG. 4 is a perspective view, the right side of which shows the front side of the temporary holding section 12 and the left side of which shows the rear side.

A drum rotation axle shaft 20 that extends in a left-right direction (see FIG. 4) is provided at a central portion of the temporary holding section 12. A circular barrel-shaped drum 21 is fixed to the drum rotation axle shaft 20.

An upper reel rotation axle shaft 22 is provided at the upper rearward side of the drum rotation axle shaft 20, and is parallel with the drum rotation axle shaft 20. A lower reel rotation axle shaft 23 is provided at the lower rearward side of the drum rotation axle shaft 20, below the upper reel rotation axle shaft 22, and is parallel with the drum rotation axle shaft 20.

Two upper tape reels 24L and 24R are pivotally supported, via respective upper reel torque limiters 25L and 25R, at predetermined locations of the upper reel rotation axle shaft 22 so as to be separated by a predetermined spacing in the axial direction (the left-right direction).

Similarly, two lower tape reels 26L and 26R are pivotally supported, via respective lower reel torque limiters 27L and 27R, at predetermined fixed positions of the lower reel rotation axle shaft 23 so as to be separated by a predetermined spacing in the axial direction (the left-right direction).

The spacing in the axial direction (the left-right direction) between the tape reels are specified to be shorter than the lengths of long sides of the banknotes BL that are to be conveyed.

Here, the upper tape reel 24L and lower tape reel 26L are a pair of upper and lower tape reels that are disposed to oppose one another in the up-down direction, and the upper tape reel 24R and lower tape reel 26R are a pair of upper and lower tape reels that are also disposed to oppose one another in the up-down direction.

That is, the temporary holding section 12 has two sets of upper and lower tape reels, one pair each at left and right.

Herein, in order to simplify descriptions, the upper tape reel 24L and lower tape reel 26L at the left side are referred to as the left upper tape reel 24L and the left lower tape reel 26L, respectively, and the upper tape reel 24R and lower tape reel 26R at the right side are referred to as the right upper tape reel 24R and the right lower tape reel 26R, respectively.

Other elements that are also provided in sets of two, as left and right pairs, are also referred to and distinguished with the terms "left" and "right" where appropriate.

In the temporary holding section 12, a left upper tape 28L is drawn out forward from the left upper tape reel 24L, is wound round a left upper tape roller 29L, which is disposed toward the left side at the upper forward side of the drum 21, and is then turned back to the rearward from the left upper tape roller 29L and guided to an upper end leftward portion of the drum 21.

A left lower tape 30L is drawn out forward from the left lower tape reel 26L, is wound round a first left lower tape roller 31L, which is disposed toward the left side at the lower forward side of the drum 21, and is then guided upward from the first left lower tape roller 31L. Then, the left lower tape 30L is wound round a second left lower tape roller 32L, which is disposed below the left upper tape roller 29L a predetermined spacing apart therefrom, is turned back to the rearward from the second left lower tape roller 32L, and is guided to the upper end leftward portion of the drum 21.

The left upper tape 28L and the left lower tape 30L are pressed against the upper end leftward portion of the drum 21, such that the left upper tape 28L is superposed on top of the left lower tape 30L, by a left pressing roller 33L, which is disposed directly above the upper end leftward portion of the drum 21. Respective distal end portions of the left upper tape 28L and left lower tape 30L are fixed to positions at the left side of a periphery side surface of the drum 21.

Similarly, a right upper tape 28R of the temporary holding section 12 is drawn out forward from the right upper tape reel 24R, is wound round a right upper tape roller 29R, which is disposed toward the right side at the upper forward side of the drum 21, and is then turned back to the rearward from the right upper tape roller 29R and guided to an upper end rightward portion of the drum 21.

Further, a right lower tape 30R is drawn out forward from the right lower tape reel 26R, is wound round a first right lower tape roller 31R, which is disposed toward the right side at the lower forward side of the drum 21, and is then guided upward from the first right lower tape roller 31R. Then, the right lower tape 30R is wound round a second right lower tape roller 32R, which is disposed below the right upper tape roller 29R a predetermined spacing apart therefrom, is turned back to the rearward from the second right lower tape roller 32R, and is guided to the upper end rightward portion of the drum 21.

Further, the right upper tape 28R and the right lower tape 30R are pressed against the upper end rightward portion of the drum 21, such that the right upper tape 28R is superposed on top of the right lower tape 30R, by a right pressing roller 33R, which is disposed directly above the upper end rightward portion of the drum 21. Respective distal end portions of the right upper tape 28R and right lower tape 30R are fixed to positions at the right side of the periphery side surface of the drum 21.

Thus, the temporary holding section 12 has two pairs of upper and lower tapes, one set each at left and right.

In the temporary holding section 12, a left upper tape position detection sensor 34L, which detects positions of the left upper tape 28L and the right upper tape position detection sensor 34R detects positions of the right upper tape 28R, and a right upper tape position detection sensor 34R are provided at, respectively, a predetermined location between the left upper tape reel 24L and the left upper tape roller 29L and a predetermined location between the right upper tape reel 24R and the right upper tape roller 29R.

Similarly, a left lower tape position detection sensor 35L, which detects positions of the left lower tape 30L and the right lower tape position detection sensor 35R detects positions of the right lower tape 30R, and a right lower tape position detection sensor 35R are provided at, respectively, a predetermined location between the left lower tape reel 26L and the first left lower tape roller 31L and a predetermined location between the right lower tape reel 26R and the first right lower tape roller 31R.

A drum rotation axle gear 40 is fixed to one end of the drum rotation axle shaft 20 of the temporary holding section 12. The drum rotation axle shaft 20 is connected to a drum driving unit 41 via the drum rotation axle gear 40.

Thus, motive force from the drum driving unit 41 is transmitted to the drum rotation axle shaft 20 via the drum rotation axle gear 40, and the drum 21 rotates together with the drum rotation axle shaft 20.

Here, the drum driving unit 41 causes the drum 21 to turn in a winding direction by causing the drum rotation axle shaft 20 to turn in the winding direction, which is the counterclockwise direction in FIG. 4. On the other hand, the drum driving unit 41 causes the drum 21 to turn in an unwinding direction by causing the drum rotation axle shaft 20 to turn in the unwinding direction, which is the clockwise direction in FIG. 4.

A drum rotation detection plate 42 is fixed to a predetermined location of the drum rotation axle shaft 20 of the temporary holding section 12. Rotation of the drum rotation detection plate 42 is detected by a rotation detection sensor 43, and thus rotation of the drum 21 is detected.

A gear 44 is fixed at the other end of the drum rotation axle shaft 20. The gear 44 meshes with a driving feed idling gear 45. Thus, the drum rotation axle shaft 20 is linked with the driving feed idling gear 45. The driving feed idling gear 45 is linked with a lower reel rotation axle shaft gear 46 and, via a rotation inversion gear 47, is linked with an upper reel rotation axle shaft gear 48.

When the drum rotation axle shaft 20 turns, for example, clockwise, this rotation is transmitted, as rotation in the same direction, to the lower reel rotation axle shaft gear 46, and the lower reel rotation axle shaft gear 46 turns clockwise. Meanwhile, the rotation is reversed by the rotation inversion gear 47 and transmitted to the upper reel rotation axle shaft gear 48, and the upper reel rotation axle shaft gear 48 turns counterclockwise.

The upper reel rotation axle shaft gear 48 is pivotally supported, via an upper one-way clutch 49, at an other end of the upper reel rotation axle shaft 22, and the lower reel rotation axle shaft gear 46 is pivotally supported, via a lower one-way clutch 50, at an other end of the lower reel rotation axle shaft 23.

The upper one-way clutch 49 transmits rotation of the upper reel rotation axle shaft gear 48 to the upper reel rotation axle shaft 22 only when the upper reel rotation axle shaft gear 48 turns in the counterclockwise direction in the drawings. Correspondingly, the lower one-way clutch 50 transmits rotation of the lower reel rotation axle shaft gear 46 to the lower reel rotation axle shaft 23 only when the lower reel rotation axle shaft gear 46 turns in the clockwise direction in the drawings.

That is, the upper one-way clutch 49 and the lower one-way clutch 50 are provided so as to transmit rotation of the drum rotation axle shaft 20 to the upper reel rotation axle shaft 22 and the lower reel rotation axle shaft 23 only when the drum rotation axle shaft 20 turns in the clockwise direction in the drawings, which is the unwinding direction.

Figure 5:
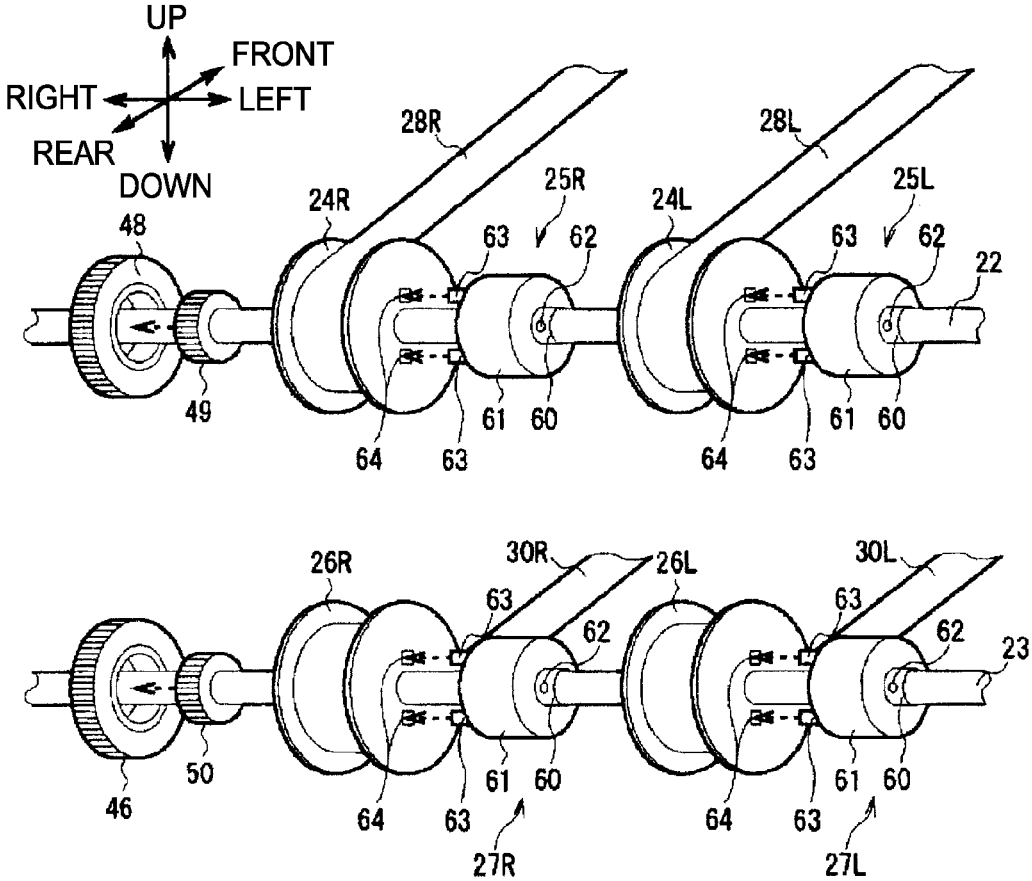
FIG. 5 is a line drawing showing structures of torque limiters and one-way clutches.

As shown in FIG. 5, the upper reel torque limiters 25L and 25R are provided so as to protrude toward one end side of the upper reel rotation axle shaft 22, along the upper reel rotation axle shaft 22 from faces at the one side of, respectively, the left upper tape reel 24L and the right upper tape reel 24R.

The upper reel torque limiters 25L and 25R are two-part structures, each with a tubular inner ring 60 at the inner side thereof and a tubular outer ring 61 at the outer side thereof.

The inner ring 60 of each of the upper reel torque limiters 25L and 25R is fixed to the upper reel rotation axle shaft 22 by a fixing pin 62. Further, a plural number (for example, two) of projection portions 63 provided at the other end side of each outer ring 61 are fitted into recess portions 64 that are formed in the one side face of the left upper tape reel 24L or right upper tape reel 24R. Thus, the outer rings 61 are each fixed to the left upper tape reel 24L or right upper tape reel 24R.

Similarly, the lower reel torque limiters 27L and 27R are provided so as to protrude toward one end side of the upper reel rotation axle shaft 22, along the upper reel rotation axle shaft 22 from faces at the one side of, respectively, the left lower tape reel 26L and the right lower tape reel 26R.

The lower reel torque limiters 27L and 27R have the same two-part structures. The inner ring 60 of each of the lower reel torque limiters 27L and 27R is fixed to the lower reel rotation axle shaft 23 by a fixing pin 62, and each outer ring 61 is fixed at the respective left lower tape reel 26L or right lower tape reel 26R by a plural number (for example, two) of the projection portions 63 that are provided at the other end side of the outer ring 61 being fitted into the recess portions 64 that are formed in the one side face of the left lower tape reel 26L or right lower tape reel 26R. Thus, the outer rings 61 are each fixed to the left lower tape reel 26L or right lower tape reel 26R.

The torque limiters 25L, 25R, 27L and 27R each take up excessive torques between the inner ring 60 and the outer ring 61.

The upper one-way clutch 49 is fitted between the upper reel rotation axle shaft gear 48 and the upper reel rotation axle shaft 22, and the lower one-way clutch 50 is fitted between the lower reel rotation axle shaft gear 46 and the lower reel rotation axle shaft 23.

In the temporary holding section 12 according to this structure, when the drum driving unit 41 is driven and the drum 21 is turned in the unwinding direction, the motive force of the drum driving unit 41 is also transmitted to the upper reel rotation axle shaft 22 and the lower reel rotation axle shaft 23, and the upper reel rotation axle shaft 22 and the lower reel rotation axle shaft 23 are turned in the winding directions thereof. Thus, the left upper tape reel 24L and right upper tape reel 24R and the left lower tape reel 26L and right lower tape reel 26R are turned in the winding directions thereof.

Therefore, the left upper tape 28L and right upper tape 28R are unwound from the drum 21 onto the left upper tape reel 24L and right upper tape reel 24R, and the left lower tape 30L and right lower tape 30R are unwound from the drum 21 onto the left lower tape reel 26L and right lower tape reel 26R.

Thus, in the temporary holding section 12, the respective tapes 28L, 28R, 30L and 30R are unwound from the drum 21 onto the respective tape reels 24L, 24R, 26L and 26R.

In this structure, the gear 44 of the drum rotation axle shaft 20 and the upper reel rotation axle shaft gear 48 are specified with a gear ratio such that a speed at which the left upper tape reel 24L and right upper tape reel 24R wind up the left upper tape 28L and right upper tape 28R is faster than a speed at which the drum 21 unwinds the left upper tape 28L and right upper tape 28R.

Similarly, the gear 44 of the drum rotation axle shaft 20 and the lower reel rotation axle shaft gear 46 are specified with a gear ratio such that a speed at which the left lower tape reel 26L and right lower tape reel 26R wind up the left lower tape 30L and right lower tape 30R is faster than a speed at which the drum 21 unwinds the left lower tape 30L and right lower tape 30R.

Thus, the speed at which the tape reels 24L, 24R, 26L and 26R wind up the tapes 28L, 28R, 30L and 30R is faster than the speed at which the drum 21 unwinds the tapes 28L, 28R, 30L and 30R. Therefore, when the tapes 28L, 28R, 30L and 30R are unwound from the drum 21 onto the tape reels 24L, 24R, 26L and 26R, tension is applied to the tapes 28L, 28R, 30L and 30R.

At this time, the upper reel torque limiters 25L and 25R interposed between the upper reel rotation axle shaft 22 and, respectively, the left upper tape reel 24L and right upper tape reel 24R operate such that tensions above a predetermined value are not applied to the left upper tape 28L and right upper tape 28R (that is, such that constant tensions are continuously applied).

In addition, the lower reel torque limiters 27L and 27R interposed between the lower reel rotation axle shaft 23 and, respectively, the left lower tape reel 26L and right lower tape reel 26R operate such that tensions above a predetermined value are not applied to the left lower tape 30L and right lower tape 30R (that is, such that constant tensions are continuously applied).

Thus, in the temporary holding section 12, each of the tapes 28L, 28R, 30L and 30R may be unwound from the drum 21 onto the tape reels 24L, 24R, 26L and 26R in a state in which constant tensions are continuously applied to the tapes 28L, 28R, 30L and 30R.

On the other hand, when the drum driving unit 41 is driven and the drum 21 is turned in the winding direction, the motive force of the drum driving unit 41 is not transmitted to the upper reel rotation axle shaft 22 and the lower reel rotation axle shaft 23.

At this time, as the tapes 28L, 28R, 30L and 30R are being wound onto the drum 21, forces in the unwinding directions are applied to the tape reels 24L, 24R, 26L and 26R.

Herein, the upper reel rotation axle shaft 22 and the lower reel rotation axle shaft 23 are structures that turn in the winding directions thereof but do not turn in the unwinding directions thereof.

That is, in this structure, although forces in the unwinding directions are applied to the tape reels 24L, 24R, 26L and 26R, the upper reel rotation axle shaft 22 and lower reel rotation axle shaft 23 do not rotate.

Therefore, the upper reel torque limiters 25L and 25R interposed between the upper reel rotation axle shaft 22 and, respectively, the left upper tape reel 24L and right upper tape reel 24R turn relative to the upper reel rotation axle shaft 22. Further, the lower reel torque limiters 27L and 27R interposed between the lower reel rotation axle shaft 23 and, respectively, the left lower tape reel 26L and right lower tape reel 26R, turn relative to the lower reel rotation axle shaft 23. Accordingly, each of the tape reels 24L, 24R, 26L and 26R rotate in the unwinding directions thereof.

Consequently, the left upper tape 28L and right upper tape 28R are wound from the left upper tape reel 24L and right upper tape reel 24R onto the drum 21, and the left lower tape 30L and right lower tape 30R are unwound from the left lower tape reel 26L and right lower tape reel 26R onto the drum 21.

Thus, the respective tapes 28L, 28R, 30L and 30R are wound onto the drum 21 from the respective tape reels 24L, 24R, 26L and 26R.

In this case too, tensions act on each of the tapes 28L, 28R, 30L and 30R that are applying forces in the unwinding directions to the tape reels 24L, 24R, 26L and 26R. However, at this time the upper reel torque limiters 25L and 25R interposed between the upper reel rotation axle shaft 22 and, respectively, the left upper tape reel 24L and right upper tape reel 24R operate such that tensions above a predetermined value are not applied to, respectively, the left upper tape 28L and the right upper tape 28R (that is, such that constant tensions are continuously applied).

In addition, the lower reel torque limiters 27L and 27R interposed between the lower reel rotation axle shaft 23 and, respectively, the left lower tape reel 26L and right lower tape reel 26R operate such that tensions above a predetermined value are not applied to the left lower tape 30L and right lower tape 30R (that is, such that constant tensions are continuously applied).

Thus, in the temporary holding section 12, the tapes 28L, 28R, 30L and 30R may be wound onto the drum 21 from the tape reels 24L, 24R, 26L and 26R in a state in which constant tensions are continuously applied to each of the tapes 28L, 28R, 30L and 30R.

The temporary holding section 12 is further provided with a conveyance roller axle shaft 70, which is parallel with the drum rotation axle shaft 20, at the forward side of the second left lower tape roller 32L and the second right lower tape roller 32R.

Two conveyance rollers 71L and 71R are fixed to the conveyance roller axle shaft 70 at predetermined locations. The conveyance rollers 71L and 71R are separated in the axial direction (the left-right direction) by a spacing shorter than the length of the long sides of the banknote BL (the length of the banknote in the direction in which the banknote is longest).

A conveyance driving gear 72 is fixed to one end of the conveyance roller axle shaft 70, and a conveyance driving section 73 is linked to the conveyance roller axle shaft 70 via the conveyance driving gear 72.

Thus, the conveyance rollers 71L and 71R are turned by motive force from the conveyance driving section 73 being transmitted to the conveyance rollers 71L and 71R via the conveyance roller axle shaft 70.

Here, the conveyance driving section 73 causes the conveyance rollers 71L and 71R to turn in a direction for storing a banknote, which is the counterclockwise direction in the drawings (hereinafter referred to as "the storing direction"), by causing the conveyance roller axle shaft 70 to turn in the storing direction. The conveyance driving section 73 also causes the conveyance rollers 71L and 71R to turn in a direction for feeding the banknotes, which is the clockwise direction in the drawings (referred to hereinafter as "the feeding direction") by causing the conveyance roller axle shaft 70 to turn in the feeding direction.

In the temporary holding section 12, a conveyance rotation detection plate 74 is fixed to a predetermined location of the conveyance roller axle shaft 70, and rotation of the conveyance rotation detection plate 74 is detected by a rotation detection sensor 75, and thus rotation of the conveyance rollers 71L and 71R is detected.

-1-4. Operations and Effects of the Temporary Storage Section-

Now, operations when a banknote BL is being stored into the temporary holding section 12 and operations when a banknote BL is being fed out from the temporary holding section 12 are described.

Figure 6:
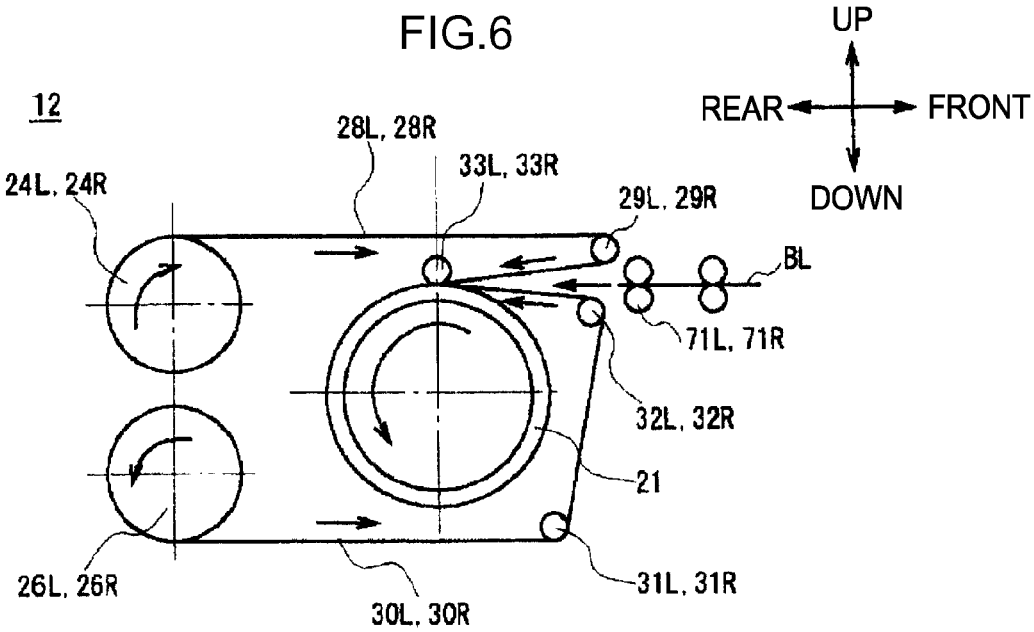
FIG. 6 is a line drawing for describing operations (1) during storage into the temporary holding section.
Figure 7:
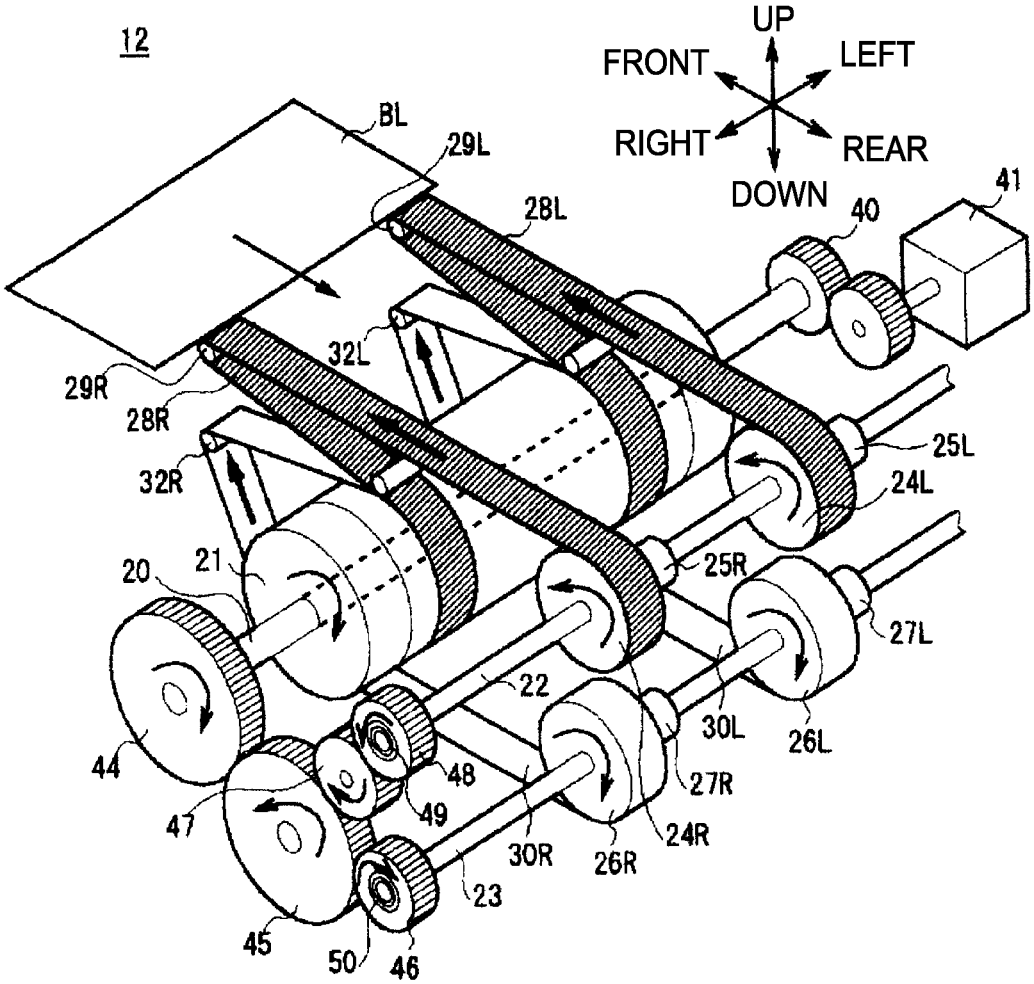
FIG. 7 is a line drawing for describing operations (2) during storage into the temporary holding section.

First, operations when a banknote BL is being stored are described using FIG. 6 and FIG. 7.

In this case, the temporary holding section 12 takes the banknote BL in between the left upper tape roller 29L and right upper tape roller 29R and the second left lower tape roller 32L and second right lower tape roller 32R by causing the conveyance rollers 71L and 71R to turn in the storing direction (not shown in FIG. 7). Here, the banknote BL is fed in with an orientation in which the long sides thereof are orthogonal to the conveyance direction.

At this time, the drum 21 causes the temporary holding section 12 to turn in the winding direction shown by the arrows in FIG. 6 and FIG. 7 by the drum driving unit 41. When the drum 21 is turned in the winding direction, as described hereabove, the tapes 28L, 28R, 30L and 30R are wound up onto the drum 21, in association with which the left upper tape reel 24L and right upper tape reel 24R turn in the unwinding direction thereof shown by the arrows in FIG. 6 and FIG. 7. Similarly, the left lower tape reel 26L and right lower tape reel 26R turn in the unwinding direction thereof shown by the arrows in FIG. 6 and FIG. 7.

As a result, one end portion in the length direction, which is the left end, of the banknote BL that is being fed in is nipped between the left upper tape 28L and the left lower tape 30L, and the right end of the banknote BL is nipped between the right upper tape 28R and the right lower tape 30R. Thus, the banknote BL is wound onto the drum 21 together with the tapes 28L, 30L, 28R and 30R.

Thus, the temporary holding section 12 winds the banknote BL onto the drum 21 and stores the banknote BL.

As described above, in the temporary holding section 12, constant tensions are applied to the tapes 28L, 30L, 28R and 30R during the storing. Therefore, the temporary holding section 12 may wind the banknote BL onto the drum 21 and store the banknote BL while both the left and right ends of the banknote BL are being assuredly nipped by the tapes 28L, 30L, 28R and 30R.

Figure 8:
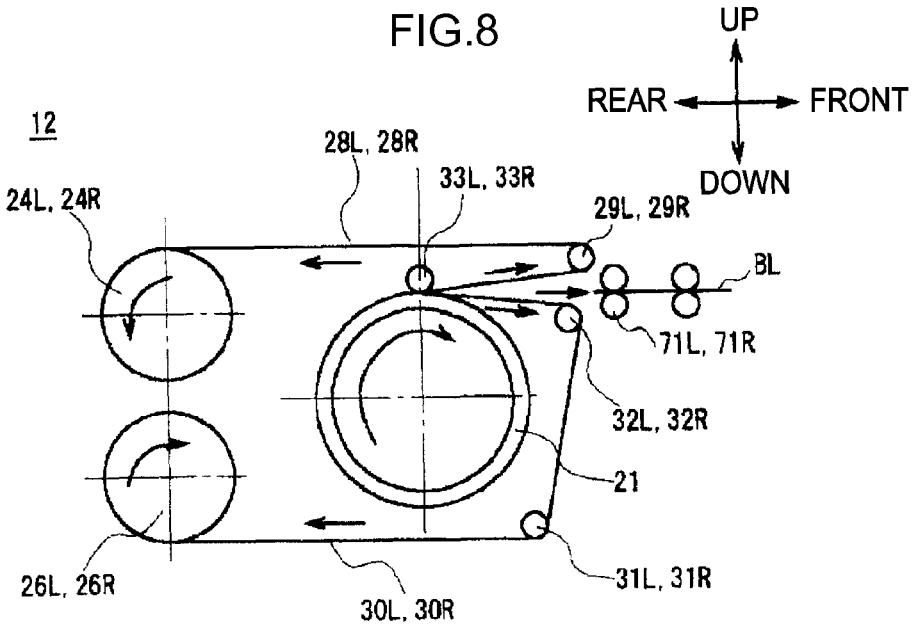
FIG. 8 is a line drawing for describing operations (1) during feeding from the temporary holding section.
Figure 9:
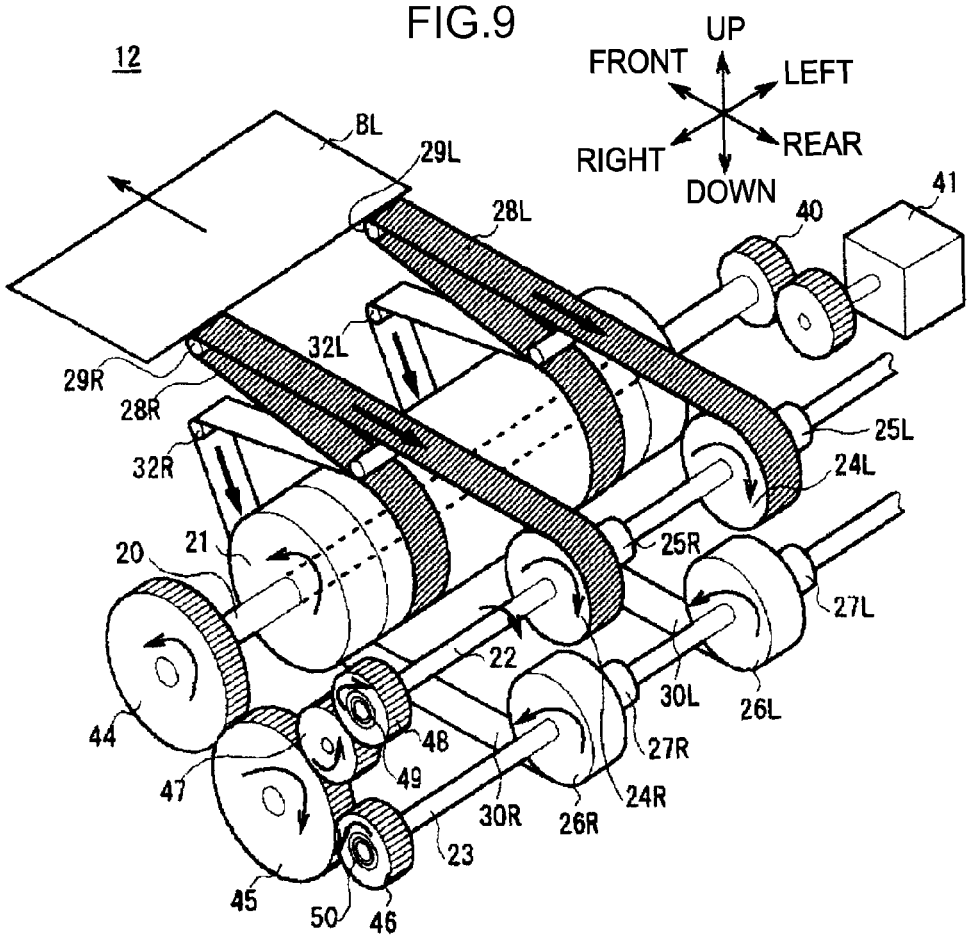
FIG. 9 is a line drawing for describing operations (2) during feeding from the temporary holding section.

Next, operations when a banknote BL is being fed out are described using FIG. 8 and FIG. 9.

At this time, the drum 21 of the temporary holding section 12 is turned in the unwinding direction shown by the arrows in FIG. 8 and FIG. 9 by the drum driving unit 41. In addition, the left upper tape reel 24L and right upper tape reel 24R are turned in the winding direction thereof shown by the arrows in FIG. 8 and FIG. 9, and the left lower tape reel 26L and right lower tape reel 26R are turned in the winding direction thereof shown by the arrows in FIG. 8 and FIG. 9.

As a result, the banknote BL that has been wound onto the drum 21 in a state of being nipped by the tapes 28L, 28R, 30L and 30R is unwound from the drum 21 together with the tapes 28L, 28R, 30L and 30R, is separated from the tapes 28L, 28R, 30L and 30R, and is then fed out forward to the conveyance rollers 71L and 71R from between the left upper tape roller 29L and right upper tape roller 29R and the second left lower tape roller 32L and second right lower tape roller 32R.

Then, the banknote BL is fed out from the temporary holding section 12 by the conveyance rollers 71L and 71R of the temporary holding section 12 being turned in the feeding direction.

Thus, the temporary holding section 12 feeds out the banknote BL.

As described above, in the temporary holding section 12, constant tensions are applied to the tapes 28L, 28R, 30L and 30R during the feeding. Therefore, the temporary holding section 12 may unwind the banknote BL from the drum 21 and feed out the banknote BL while both the left and right ends of the banknote BL are being assuredly nipped by the tapes 28L, 28R, 30L and 30R.

Figure 10:
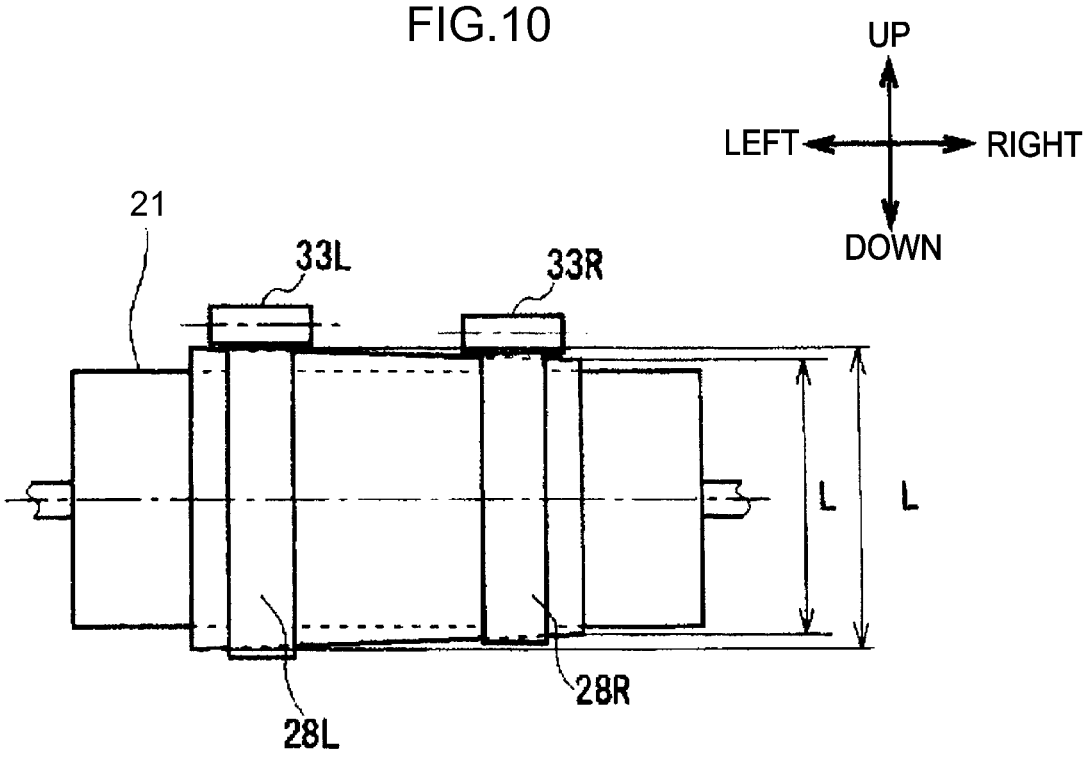
FIG. 10 is a line drawing showing a situation in which a winding diameter of a drum of the temporary holding section of the first embodiment is uneven.

Now, in this drum winding system temporary holding section 12, as shown in FIG. 10, a winding diameter L when banknotes are wound on the drum 21 may be inconsistent between the two axial direction end portions of the drum 21 because of characteristics of the banknotes (uneven thicknesses and the like).

In this case, a winding amount and an unwinding amount of the tapes per rotation of the drum are different between the pair of upper and lower tapes 28L and 30L at the left side and the pair of upper and lower tapes 28R and 30R at the right side. As a result, there are differences in tape speeds between the pairs of upper and lower tapes during storing and during feeding of a banknote BL.

Supposing such a state, in the temporary holding section 12 of the present embodiment, the torque limiters 25L, 25R, 27L and 27R that operate independently are provided at, respectively, the tape reels 24L, 24R, 26L and 26R.

Accordingly, the torque limiters 25L, 25R, 27L and 27R operate respectively independently so as to keep the tensions of the tapes 28L, 28R, 30L and 30R between the tape reels 24L, 24R, 26L and 26R and the drum 21 continuously constant.

Thus, the temporary holding section 12 may keep the tensions of all the tapes 28L, 28R, 30L and 30R of the pairs of upper and lower tapes continuously constant irrespective of differences in tape speeds between the pairs of tapes.

Therefore, because the temporary holding section 12 may keep the tensions on all of the tapes 28L, 28R, 30L and 30R nipping the banknote BL continuously constant, nipping stability of banknotes may be further improved compared to the related art.

According to the structure described above, the temporary holding section 12 may keep the tensions of all the tapes 28L, 28R, 30L and 30R nipping a banknote BL continuously constant even under conditions in which there is a difference in the winding diameter L at the two end portions of the drum 21. Consequently, the temporary holding section 12 may further improve banknote nipping stability over the related art, as a result of which faults such as jams and the like during storing and during feeding of the banknotes BL may be more assuredly prevented.

-2. Second Embodiment-

Next, a second embodiment is described. The second embodiment features a temporary holding section with a different structure from the temporary holding section according to the first embodiment. Accordingly, only the structure of this temporary holding section is described.

-2-1. Structure of the Temporary Holding Section-

Figure 11:
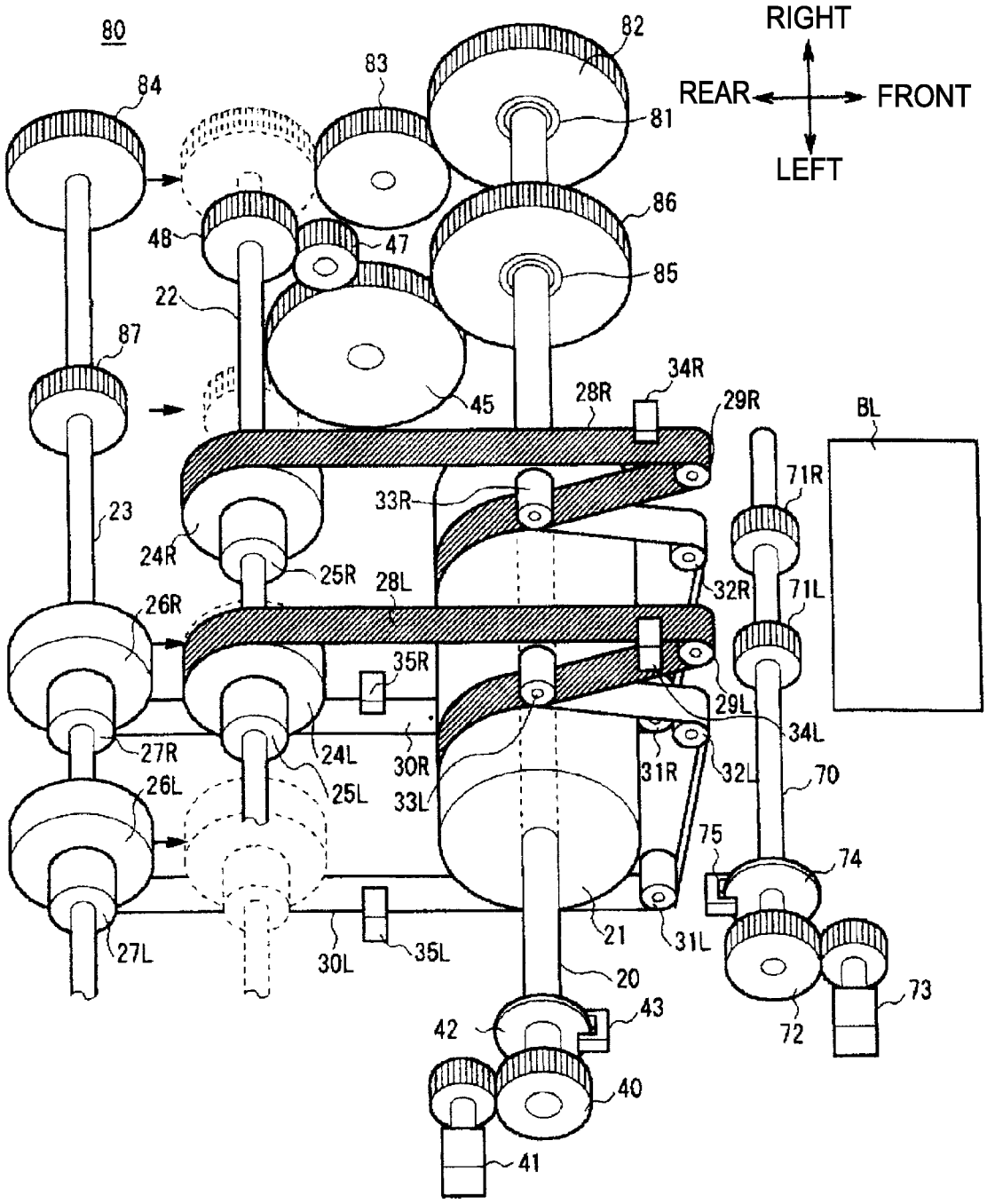
FIG. 11 is a line drawing showing structures of a temporary holding section of a second embodiment.

A temporary holding section 80 according to the second embodiment is shown in FIG. 11. Portions of the temporary holding section 80 shown in FIG. 11 that are the same as in the temporary holding section 12 of the first embodiment are assigned the same reference numerals, and descriptions of portions that are the same are omitted as appropriate.

The temporary holding section 80 differs from the temporary holding section 12 of the first embodiment in the structure of the gears. That is, a driving gear for winding 82 is pivotally supported, via a one-way clutch for winding driving 81, at the other end of the drum rotation axle shaft 20 of the temporary holding section 80.

The driving gear for winding 82 is linked to a lower reel rotation axle shaft first gear 84, via a driving link idling gear 83. The lower reel rotation axle shaft first gear 84 is fixed to the other end of the lower reel rotation axle shaft 23.

Meanwhile, a driving gear for unwinding 86 is pivotally supported, via a one-way clutch for unwinding driving 85, at a predetermined location of the drum rotation axle shaft 20 between the driving gear for winding 82 and the drum 21.

The driving gear for unwinding 86 is linked to the driving feed idling gear 45, and the driving feed idling gear 45 is linked to the upper reel rotation axle shaft gear 48 via the rotation inversion gear 47.

The upper reel rotation axle shaft gear 48 is fixed to the other end of the upper reel rotation axle shaft 22.

The driving feed idling gear 45 is linked with a lower reel rotation axle shaft second gear 87, which is fixed to a predetermined location of the lower reel rotation axle shaft 23 between the lower reel rotation axle shaft first gear 84 and the right lower tape reel 26R.

The one-way clutch for winding driving 81 transmits rotation of the drum rotation axle shaft 20 to the driving gear for winding 82 only when the drum rotation axle shaft 20 turns in the winding direction, which is the counterclockwise direction in FIG. 11.

Meanwhile, the one-way clutch for unwinding driving 85 transmits rotation of the drum rotation axle shaft 20 to the driving gear for unwinding 86 only when the drum rotation axle shaft 20 turns in the unwinding direction, which is the clockwise direction in FIG. 11.

Thus, in the temporary holding section 80, when the drum 21 is turned in the winding direction by the drum driving unit 41, this rotation is transmitted to the lower reel rotation axle shaft 23 via the driving gear for winding 82, the driving link idling gear 83 and the lower reel rotation axle shaft first gear 84, and the lower reel rotation axle shaft 23 is turned in the unwinding direction thereof.

In the temporary holding section 80 at this time, the rotation of the lower reel rotation axle shaft 23 is further transmitted to the upper reel rotation axle shaft 22 via the lower reel rotation axle shaft second gear 87, the driving feed idling gear 45, the rotation inversion gear 47 and the upper reel rotation axle shaft gear 48. Thus, the upper reel rotation axle shaft 22 is also turned in the unwinding direction thereof.

Thus, the left upper tape 28L and the right upper tape 28R are wound up onto the drum 21 from the left upper tape reel 24L and the right upper tape reel 24R and, similarly, the left lower tape 30L and the right lower tape 30R are wound up onto the drum 21 from the left lower tape reel 26L and the right lower tape reel 26R.

In this manner, the temporary holding section 80 winds the tapes 28L, 28R, 30L and 30R onto the drum 21 from the tape reels 24L, 24R, 26L and 26R.

Here, the driving gear for winding 82 and the upper reel rotation axle shaft gear 48 are specified with a gear ratio such that the speed at which the left upper tape reel 24L and right upper tape reel 24R unwind the left upper tape 28L and right upper tape 28R is slower than the speed at which the drum 21 winds up the left upper tape 28L and right upper tape 28R.

Similarly, the driving gear for winding 82 and the lower reel rotation axle shaft first gear 84 are specified with a gear ratio such that the speed at which the left lower tape reel 26L and right lower tape reel 26R unwind the left lower tape 30L and right lower tape 30R is slower than the speed at which the drum 21 winds up the left lower tape 30L and right lower tape 30R.

If the speeds at which the tape reels 24L, 24R, 26L and 26R unwind the tapes 28L, 28R, 30L and 30R is slower than the speeds at which the drum 21 winds up the tapes 28L, 28R, 30L and 30R, when the tapes 28L, 28R, 30L and 30R are wound onto the drum 21 from the tape reels 24L, 24R, 26L and 26R, tension is applied to the tapes 28L, 28R, 30L and 30R.

At this time, the upper reel torque limiters 25L and 25R interposed between the upper reel rotation axle shaft 22 and, respectively, the left upper tape reel 24L and right upper tape reel 24R operate such that tensions above a predetermined value are not applied to the left upper tape 28L and right upper tape 28R (that is, such that constant tensions are continuously applied).

In addition, the lower reel torque limiters 27L and 27R interposed between the lower reel rotation axle shaft 23 and, respectively, the left lower tape reel 26L and right lower tape reel 26R operate such that tensions above a predetermined value are not applied to the left lower tape 30L and right lower tape 30R (that is, such that constant tensions are continuously applied).

Thus, in the temporary holding section 80 too, the tapes 28L, 28R, 30L and 30R may be wound onto the drum 21 from the tape reels 24L, 24R, 26L and 26R in a state in which constant tensions are continuously applied to the tapes 28L, 28R, 30L and 30R.

On the other hand, in the temporary holding section 80, when the drum 21 is driven to turn in the unwinding direction by the drum driving unit 41, this rotation is transmitted to the lower reel rotation axle shaft 23 via the driving gear for unwinding 86, the driving feed idling gear 45 and the lower reel rotation axle shaft second gear 87, and the lower reel rotation axle shaft 23 is turned in the winding direction thereof.

Further, in the temporary holding section 80, the rotation by the drum driving unit 41 is further transmitted to the upper reel rotation axle shaft 22 via the driving gear for unwinding 86, the driving feed idling gear 45, the rotation inversion gear 47 and the upper reel rotation axle shaft gear 48, and the upper reel rotation axle shaft 22 is also turned in the winding direction thereof.

Thus, the left upper tape 28L and the right upper tape 28R are unwound from the drum 21 onto the left upper tape reel 24L and the right upper tape reel 24R. Similarly, the left lower tape 30L and the right lower tape 30R are unwound from the drum 21 onto the left lower tape reel 26L and the right lower tape reel 26R.

In this manner, the temporary holding section 80 unwinds the tapes 28L, 28R, 30L and 30R from the drum 21 onto the tape reels 24L, 24R, 26L and 26R.

Here, the driving gear for unwinding 86 and the upper reel rotation axle shaft gear 48 are specified with a gear ratio such that the speed at which the left upper tape reel 24L and right upper tape reel 24R wind up the left upper tape 28L and right upper tape 28R is faster than the speed at which the drum 21 unwinds the left upper tape 28L and right upper tape 28R.

Similarly, the driving gear for winding 82 and the lower reel rotation axle shaft second gear 87 are specified with a gear ratio such that the speed at which the left lower tape reel 26L and right lower tape reel 26R wind up the left lower tape 30L and right lower tape 30R is faster than the speed at which the drum 21 unwinds the left lower tape 30L and right lower tape 30R.

Thus, the speed at which the tape reels 24L, 24R, 26L and 26R wind up the tapes 28L, 28R, 30L and 30R is faster than the speed at which the drum 21 unwinds the tapes 28L, 28R, 30L and 30R. Therefore, when the tapes 28L, 28R, 30L and 30R are unwound from the drum 21 onto the tape reels 24L, 24R, 26L and 26R, tension is applied to the tapes 28L, 28R, 30L and 30R.

At this time, the upper reel torque limiters 25L and 25R interposed between the upper reel rotation axle shaft 22 and, respectively, the left upper tape reel 24L and right upper tape reel 24R operate such that tensions above a predetermined value are not applied to the left upper tape 28L and right upper tape 28R (that is, such that constant tensions are continuously applied).

In addition, the lower reel torque limiters 27L and 27R interposed between the lower reel rotation axle shaft 23 and, respectively, the left lower tape reel 26L and right lower tape reel 26R operate such that tensions above a predetermined value are not applied to the left lower tape 30L and right lower tape 30R (that is, such that constant tensions are continuously applied).

Thus, in the temporary holding section 80 too, the tapes 28L, 28R, 30L and 30R may be unwound from the drum 21 onto the tape reels 24L, 24R, 26L and 26R in a state in which constant tensions are continuously applied to the tapes 28L, 28R, 30L and 30R.

The temporary holding section 80 stores and feeds banknotes BL by winding and unwinding these tapes 28L, 28R, 30L and 30R.

Further, in the temporary holding section 80 too, the torque limiters 25L, 25R, 27L and 27R operate respectively independently so as to keep the tensions of the tapes 28L, 28R, 30L and 30R between the tape reels 24L, 24R, 26L and 26R and the drum 21 continuously constant. Thus, the temporary holding section 80 may keep the tensions of all the tapes 28L, 28R, 30L and 30R of the pairs of upper and lower tapes continuously constant irrespective of differences in tape speeds between the pairs of tapes.

Thus, because the temporary holding section 80 may keep the tensions on all of the tapes 28L, 28R, 30L and 30R nipping a banknote BL continuously constant, nipping stability of banknotes may be further improved compared to the related art, similarly to the temporary holding section 12 according to the first embodiment.

-3. Other Embodiments-

-3-1. Other Embodiments: 1-

In the first and second embodiments described above, as shown in FIG. 5, the upper reel torque limiters 25L and 25R are provided so as to protrude to the one end side of the upper reel rotation axle shaft 22 from the respective one side faces of the left upper tape reel 24L and the right upper tape reel 24R.

The lower reel torque limiters 27L and 27R too are provided so as to protrude to the one end side of the upper reel rotation axle shaft 22 from the respective one side faces of the left lower tape reel 26L and the right lower tape reel 26R.

In other words, in the embodiments described above, the torque limiters 25L, 25R, 27L and 27R are provided so as to protrude to the axial direction one end sides from the respective one side faces of the tape reels 24L, 24R, 26L and 26R.

Figure 12:
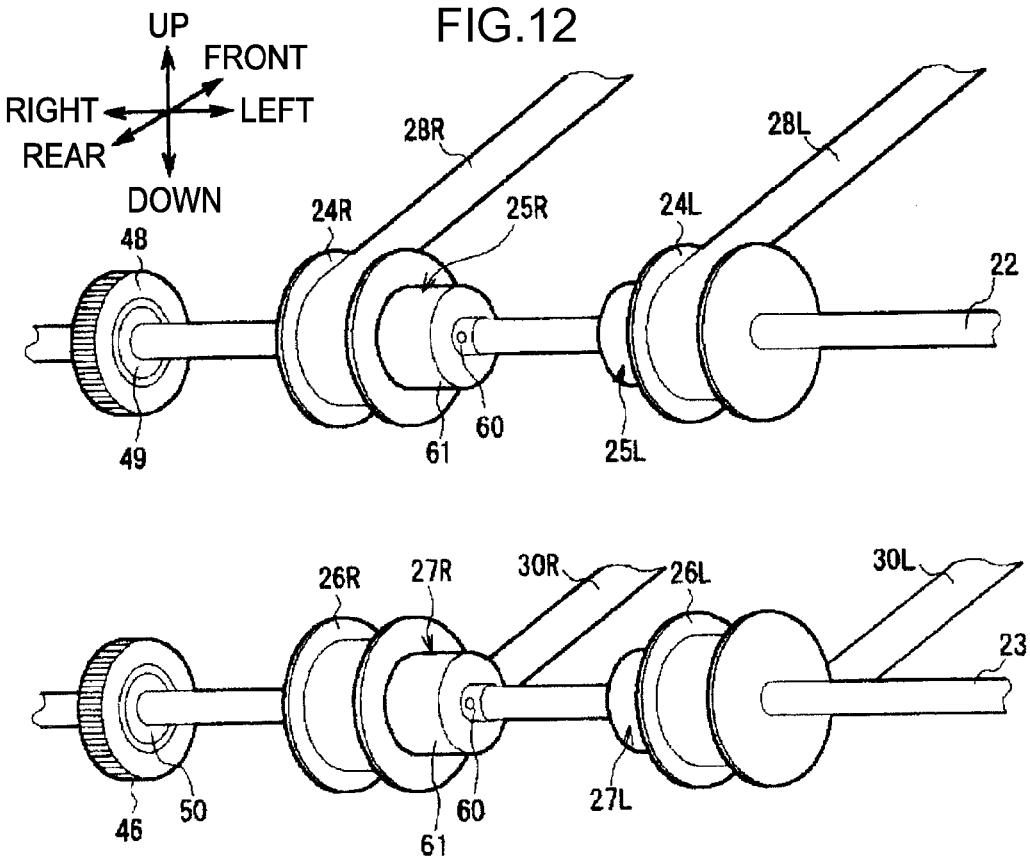
FIG. 12 is a line drawing showing an attachment orientation of torque limiters in another embodiment.

This is not limiting, for example, as shown in FIG. 12, the upper reel torque limiters 25L and 25R may be provided so as to each be disposed between the left upper tape reel 24L and the right upper tape reel 24R. Further, the lower reel torque limiters 27L and 27R may be provided so as to each be disposed between the left lower tape reel 26L and the right lower tape reel 26R.

In this case, the upper reel torque limiter 25R and the lower reel torque limiter 27R are mounted so as to protrude to the axial direction one end side at the respective one side faces, which are at the inner side, of the right upper tape reel 24R and the right lower tape reel 26R, the same as in the first embodiment.

On the other hand, in contrast to the first embodiment, the upper reel torque limiter 25L and the lower reel torque limiter 27L are mounted so as to protrude to the axial direction other end side at the respective other side faces, which are at the inner side, of the right upper tape reel 24R and the right lower tape reel 26R.

Like this, the upper reel torque limiters 25L and 25R are disposed between the left upper tape reel 24L and the right upper tape reel 24R, and the lower reel torque limiters 27L and 27R are disposed between the left lower tape reel 26L and the right lower tape reel 26R. Accordingly, space is created at the outer sides of the left upper tape reel 24L and the right upper tape reel 24R and at the outer sides of the left lower tape reel 26L and the right lower tape reel 26R. In consequence, this space at the outer sides may be efficiently utilized. For example, a casing of the temporary holding section 12 or 80 may be made narrower and reduced in size.

-3-2. Other Embodiments: 2-

In the first and second embodiments described above, as shown in FIG. 3, the present invention is applied to the temporary holding sections 12 and 80 that are "top winding" systems, in which a banknote nipped by two pairs of upper and lower tapes is wound on and taken in from an upper end portion of a drum.

This is not limiting, and the present invention may be applied to a temporary holding section that is a "bottom winding" system, in which a banknote nipped by two pairs of upper and lower tapes is wound on and taken in from a lower end portion of a drum.

Figure 13:
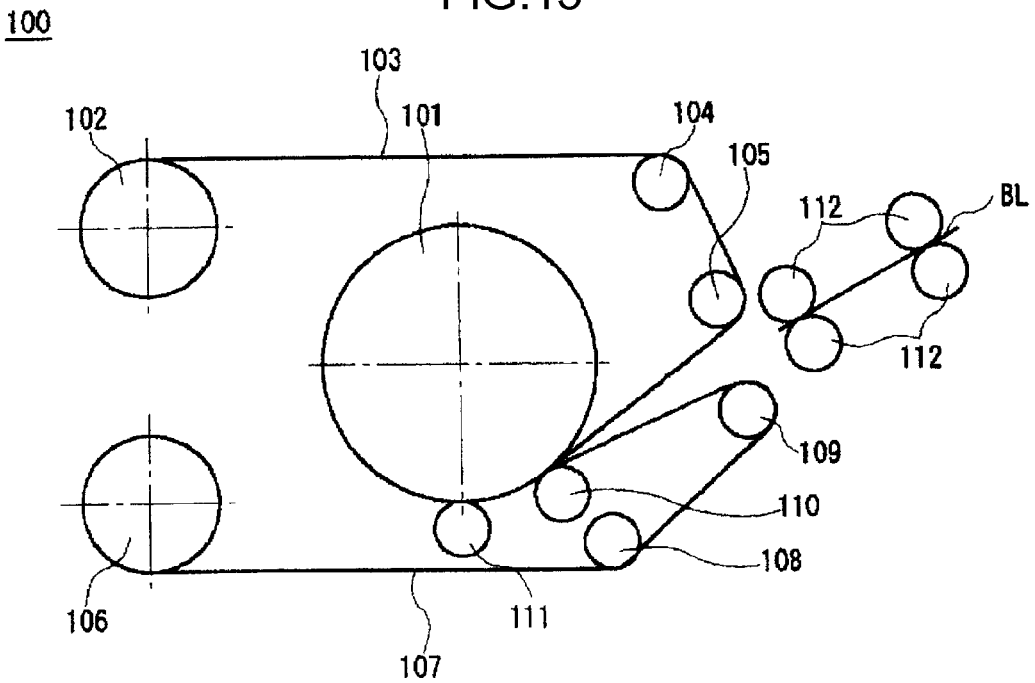
FIG. 13 is a line drawing showing the structure of a temporary holding section of another embodiment.
Figure 14:
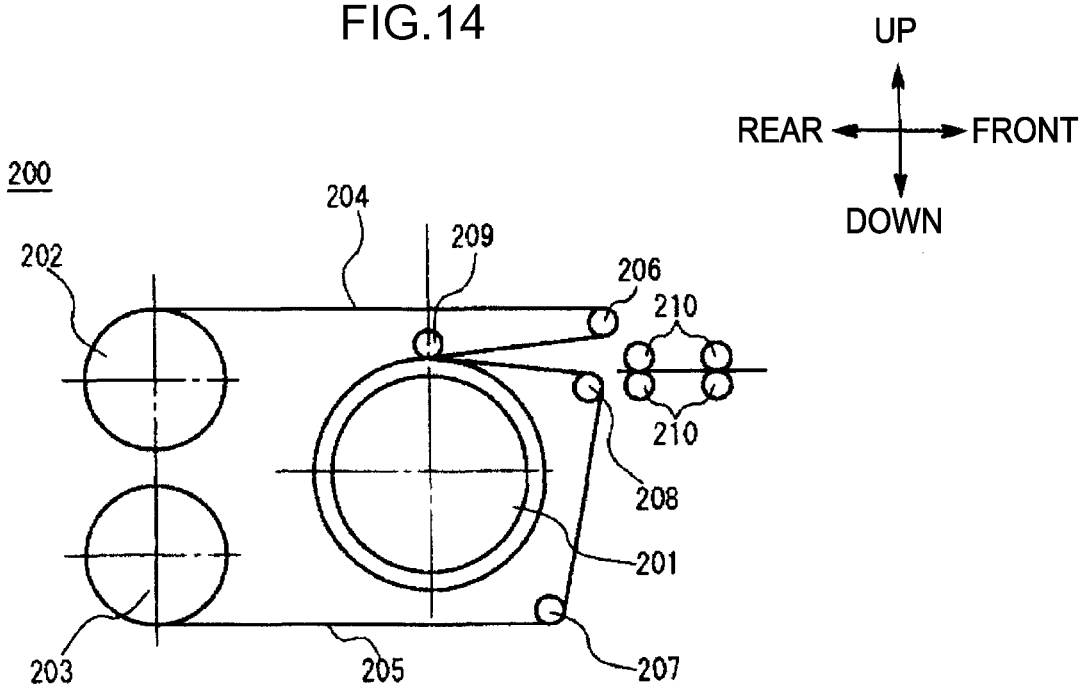
FIG. 14 is a line drawing showing the structure of a related art temporary holding section.
Figure 15:
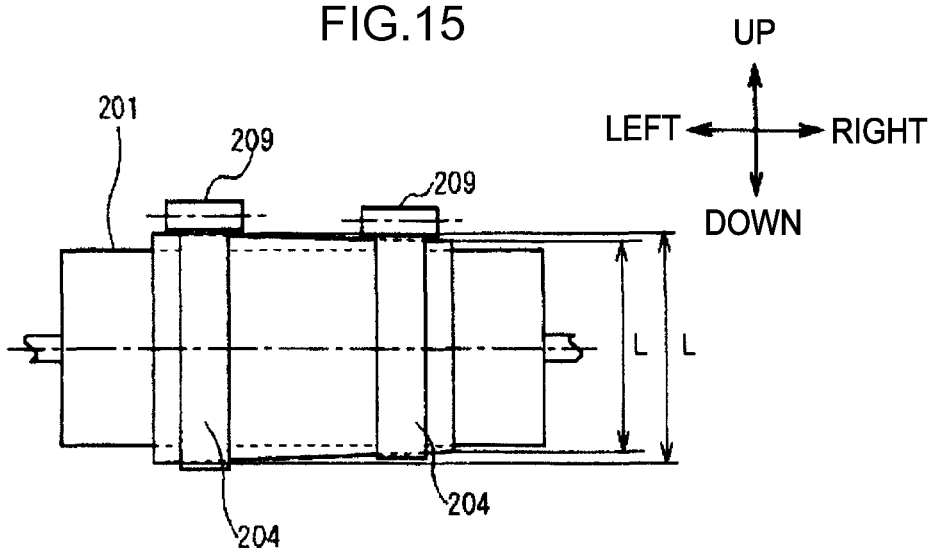
FIG. 15 is a line drawing showing a situation in which a winding diameter of a drum of the related art temporary holding section is uneven.

A temporary holding section 100 of this bottom winding system is shown in FIG. 13. In the temporary holding section 100, an upper tape 103 is drawn out forward from an upper tape reel 102, which is disposed at the upper rearward side of a circular barrel-shaped drum 101, and is wound round an upper first tape roller 104, which is disposed at the upper forward side of the drum 101. The upper tape 103 is then guided downward from the upper first tape roller 104, turned back to the rearward from an upper second tape roller 105, which is disposed below the upper first tape roller 104, and guided to a lower end portion of the drum 101.

Meanwhile, a lower tape 107 is drawn out forward from a lower tape reel 106, which is disposed at the lower rearward side of the drum 101, and is wound round a lower first tape roller 108, which is disposed at the lower forward side of the drum 101. The lower tape 107 is then guided diagonally upward and forward from the lower first tape roller 108, and wound round a lower second tape roller 109, which is disposed below the upper second tape roller 105 a predetermined spacing apart therefrom. Hence, the lower tape 107 is turned back to the rearward from the lower second tape roller 109 and guided to the lower end portion of the drum 101.

Further, the upper tape 103 and the lower tape 107 are pressed against the lower end portion of the drum 101, such that the upper tape 103 is superposed on top of the lower tape 107, by a first pressing roller 110, which is disposed at the forward side of the lower end portion of the drum 101, and a second pressing roller 111, which is disposed directly below the lower end portion of the drum 101, and respective distal end portions of the upper tape 103 and lower tape 107 are fixed to positions of a periphery side surface of the drum 101.

Although not shown in FIG. 13, each of the upper tape reel 102, the upper tape 103, the upper first tape roller 104, the upper second tape roller 105, the lower tape reel 106, the lower tape 107, the lower first tape roller 108, the lower second tape roller 109, the first pressing roller 110 and the second pressing roller 111 is provided as a left and right pair.

Further, the temporary holding section 100 winds the upper tapes 103 and the lower tapes 107 onto the drum 101 from the upper tape reels 102 and the lower tape reels 106 by turning the drum 101 in a winding direction thereof, which is the clockwise direction in FIG. 13. On the other hand, the temporary holding section 100 unwinds the upper tapes 103 and the lower tapes 107 from the drum 101 onto the upper tape reels 102 and the lower tape reels 106 by turning the drum 101 in an unwinding direction thereof, which is the counterclockwise direction in FIG. 13.

The bottom winding system temporary holding section 100 has this structure. Thus, when a banknote is being stored, the banknote BL is conveyed through a plural number of conveyance rollers 112 that are disposed at the forward side and the banknote BL is taken in between the upper second tape rollers 105 and the lower second tape rollers 109. At this time, the temporary holding section 100 causes the drum 101 to turn in the winding direction thereof, causes the upper tape reels 102 and the lower tape reels 106 to turn in the unwinding directions thereof, nips the banknote BL with the left and right pairs of upper tapes 103 and lower tapes 107, and winds the banknote BL onto the drum 101. Thus, the banknote BL is stored.

When a banknote is being fed out, the temporary holding section 100 causes the drum 101 to turn in the unwinding direction thereof, causes the upper tape reels 102 and the lower tape reels 106 to turn in the winding directions thereof, and unwinds the banknote BL from the drum 101 together with the left and right pairs of upper tapes 103 and lower tapes 107. Thus, the temporary holding section 100 feeds the banknote BL out from between the upper second tape rollers 105 and the lower second tape rollers 109.

In this manner, the bottom winding system temporary holding section 100 stores and feeds out banknotes BL.

-3-3. Other Embodiments: 3-

In the first and second embodiments described above, two pairs of upper and lower tapes are provided in the temporary holding section 12 or 80. However, this is not a limitation, and three or more pairs may be provided.

In a case in which three or more pairs of upper and lower tapes are provided thus, the same effects as in the above-described temporary holding section 12 and 80 may be obtained by providing independently operating torque limiters at each of the tape reels that wind and unwind the tapes.

-3-4. Other Embodiments: 4-

In the first and second embodiments described above, the torque limiters 25L, 25R, 27L and 27R are used as torque control units that control torques between the tape reels 24L, 24R, 26L and 26R and the reel rotation axle shafts 22 and 23. However, this is not limiting. Other mechanisms that function similarly to the torque limiters 25L, 25R, 27L and 27R may be used instead of the torque limiters 25L, 25R, 27L and 27R.

-3-5. Other Embodiments: 5-

In the first embodiment described above, the one-way clutches 49 and 50 are used as rotation direction control units that restrict the turning directions of the reel rotation axle shafts 22 and 23. However, this is not limiting. Other mechanisms that function similarly to the one-way clutches 49 and 50 may be used instead of the one-way clutches 49 and 50.

Similarly, in the second embodiment, mechanisms that function similarly to the one-way clutches 81 and 85 may be used instead of the one-way clutches 81 and 85.

-3-6. Other Embodiments: 6-

In the first and second embodiments described above, the present invention is applied to the temporary holding section 12 or 80 that functions as a medium storage and feeding device of the banknote deposit and withdrawal apparatus 4 provided at the ATM 1. However, this is not limiting. The present invention may be applied to an apparatus other than the temporary holding section 12 or 80, provided the apparatus is a drum winding system medium storage and feeding device, and further applications are possible. The present invention may be applied to, as apparatuses other than the temporary holding section 12 or 80, medium storage and feeding devices that handle media other than banknotes (for example, event tickets, travel tickets, paper documents and so forth).

In the embodiments described above, the present invention is applied to a medium processing device that is the ATM 1. However, this is not limiting. The present invention may be applied to a device other than the ATM 1, provided the device is a medium processing device includes a drum winding system temporary holding section, and further applications are possible. The present invention may be applied to, as devices other than the ATM 1, medium processing devices that handle media other than banknotes (for example, event tickets, travel tickets, paper documents and so forth).

-3-7. Other Embodiments: 7-

Furthermore, the present invention is not limited to the embodiments described above and the other embodiments described above. That is, the present invention encompasses a technical scope that includes embodiments that arbitrarily combine part or the whole of an embodiment described above or an other embodiment described above, and embodiments partially derived therefrom.

Industrial Applicability

The present invention may be widely employed in devices such as ATMs that handle banknotes and the like.

Explanation of the Reference Numerals

1 ATM
4 Banknote deposit and withdrawal apparatus
12, 80, 100, 200 Temporary holding section
20 Drum rotation axle shaft
21, 101, 201 Drum
22, 23 Reel rotation axle shaft
24L, 24R, 26L, 26R, 102, 106, 202, 203 Tape reel
25L, 25R, 27L, 27R Torque limiter
28L, 28R, 30L, 30R, 103, 107, 204, 205 Tape
49, 50, 81, 85 One-way clutch

The invention claimed is:

1. A medium storage and feeding device that stores and feeds out a medium by winding and unwinding a set of two tapes, which nip the medium, between tape reels and a drum, the medium storage and feeding device comprising:

a plurality of sets of the tapes;

a plurality of sets of the tape reels that respectively wind up the plurality of sets of tapes;

two reel rotation axle shafts that are rotation axles of the tape reels and that are separately provided for one tape reel and another tape reel of the respective sets;

a drum that winds the medium nipped by the plurality of sets of tapes together with the plurality of sets of tapes; and torque applying units that are independently provided at each of the tape reels and that apply torques to each of the tape reels such that tensions on the tapes between the tape reels and the drum are constant, when each of the tape reels rotates in a direction of winding the tapes and in a direction of unwinding the tapes.

2. The medium storage and feeding device according to claim 1, wherein:

a drum rotation axle shaft, which is a rotation axle of the drum, is linked with the two reel rotation axle shafts by respective pluralities of gears for winding and pluralities of gears for unwinding;

gear ratios of the pluralities of gears for winding are specified such that a speed at which the tapes are unwound from the tape reels is slower than a speed at which the tapes are wound onto the drum;

gear ratios of the pluralities of gears for unwinding are specified such that a speed at which the tapes are wound onto the tape reels is faster than a speed at which the tapes are unwound from the drum; and the device further comprises:

rotation direction control portions for winding driving that are provided between the drum rotation axle shaft and each of the two reel rotation axle shafts, and that transmit rotation of the drum rotation axle shaft to the two reel rotation axle shafts via the pluralities of gears for winding only when the rotation direction of the rotation axle shaft is the direction of winding onto the drum; and rotation direction control portions for unwinding driving that are provided between the drum rotation axle shaft and each of the two reel rotation axle shafts, and that transmit rotation of the drum rotation axle shaft to the two reel rotation axle shafts via the pluralities of gears for unwinding only when the rotation direction of the rotation axle shaft is the direction of unwinding from the drum.

3. The medium storage and feeding device according to claim 1, wherein:

a drum rotation axle shaft, which is a rotation axle of the drum, is linked with the two reel rotation axle shafts by respective pluralities of gears;

gear ratios of the pluralities of gears are specified such that a speed at which the tapes are wound onto the tape reels is faster than a speed at which the tapes are unwound from the drum; and the device further comprises rotation direction control portions that are provided between the drum rotation axle shaft and each of the two reel rotation axle shafts, and that transmit rotation of the drum rotation axle shaft to the two reel rotation axle shafts via the pluralities of gears only when the rotation direction of the drum rotation axle shaft is the direction of unwinding from the drum.

4. The medium storage and feeding device according to claim 3, wherein:

the number of sets of tapes is two;

the respective tape reels of a first set and tape reels of a second set are pivotally supported at the two reel rotation axle shafts and are separated by a predetermined spacing; and the torque applying units are disposed in the spaces between the first set of tape reels and the second set of tape reels.

5. A medium processing device comprising:

a verification section that verifies a medium;

a temporary holding section that temporarily stores a medium verified by the verification section; and a banknote storage vault that stores a medium fed out from the temporary holding section;

wherein the temporary holding section is a drum winding system that stores and feeds out a medium by winding and unwinding a set of two tapes, which nip the medium, between tape reels and a drum, and the temporary holding section includes:

a plurality of sets of the tapes;

a plurality of sets of the tape reels that respectively wind up the plurality of sets of tapes;

two reel rotation axle shafts that are rotation axles of the tape reels and that are separately provided for one tape reel and another tape reel of the respective sets;

a drum that winds the medium nipped by the plurality of sets of tapes together with the plurality of sets of tapes; and torque applying units that are independently provided at each of the tape reels and that apply torques to each of the tape reels such that tensions on the tapes between the tape reels and the drum are constant, when each of the tape reels rotates in a direction of winding the tapes and in a direction of unwinding the tapes.

* * * * *